United States Patent [19]

Weise

[11] 4,237,979

[45] Dec. 9, 1980

[54] VALVE FOR HYDRAULIC SETTING PACKER SETTING TOOL AND METHOD OF SETTING A HYDRAULICALLY SETTABLE PACKER THEREWITH

[75] Inventor: Stanley A. Weise, Dallas, Tex.

[73] Assignee: Dresser Industries, Inc., Dallas, Tex.

[21] Appl. No.: 4,647

[22] Filed: Jan. 19, 1979

[51] Int. Cl.[3] ..... E21B 33/128; E21B 33/129

[52] U.S. Cl. ..... 166/315; 166/120; 166/123

[58] Field of Search ..... 166/315, 120–122, 166/131, 134, 334, 124

[56] References Cited

U.S. PATENT DOCUMENTS

| | | | |
|---|---|---|---|
| 3,011,558 | 12/1961 | Conrad | 166/212 |
| 3,306,363 | 2/1967 | McZilkey et al. | 166/134 X |
| 3,448,806 | 6/1969 | Berryman et al. | 166/124 X |
| 4,044,826 | 8/1977 | Crowe | 166/120 |
| 4,151,876 | 5/1979 | Briggs et al. | 166/134 |

OTHER PUBLICATIONS

Baker Oil Tool Catalog 1978–1979, p. 810, Product No. 487-20.

*Primary Examiner*—Ernest R. Purser
*Attorney, Agent, or Firm*—J. N. Hazelwood; W. R. Peoples

[57] ABSTRACT

A valve assembly is mounted with the setting tool for a hydraulically actuated well packer. The valve is located at a fluid passage in the setting tool and movable to control fluid flow from inside the setting tool to the well packer setting mechanism. In using this equipment, the valve is open when the setting tool is positioned within the well packer for setting of the well packer so fluid can pass through the setting tool and into the packer hydraulic setting mechanism. The valve is closed when the setting tool is removed from the well packer in order that fluid can flow through the setting tool and also through the bore of the well packer mandrel for fluid communication through the well tubing to a location below the packer without leakage into the annular cavity above or below the packer.

22 Claims, 8 Drawing Figures

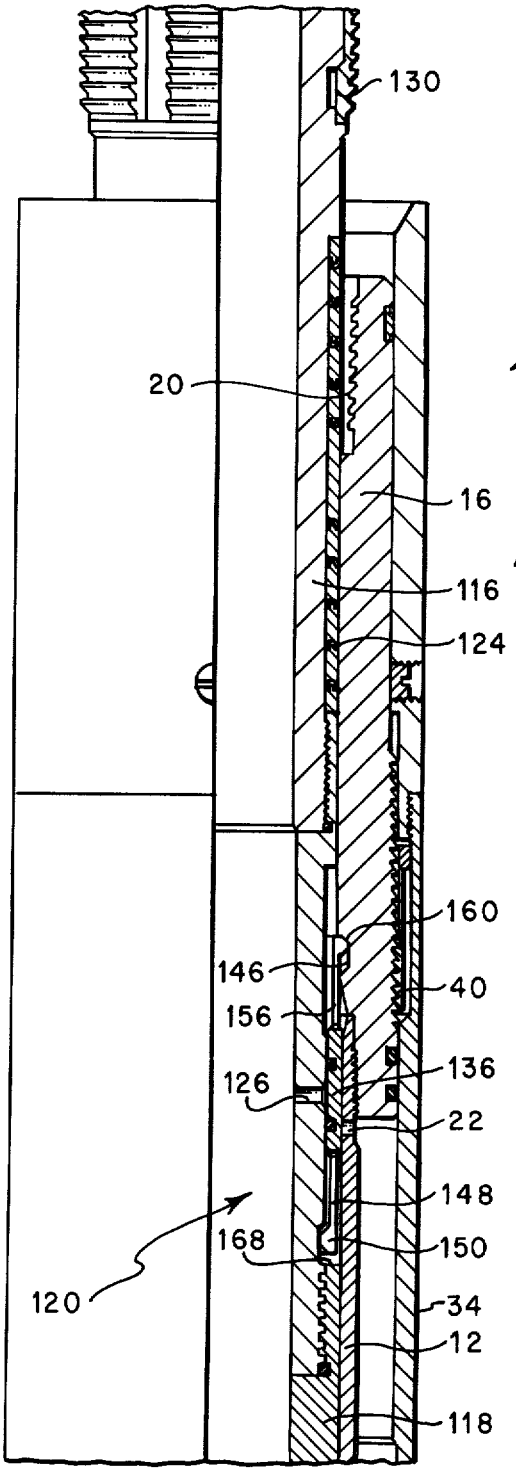
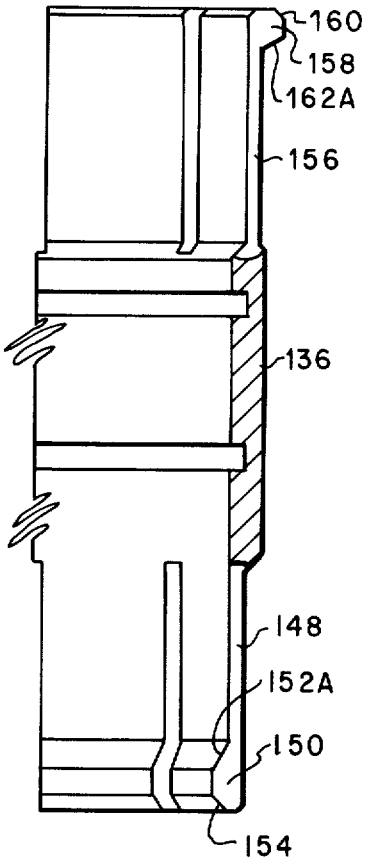
FIG. 6
FIG. 3

VALVE FOR HYDRAULIC SETTING PACKER SETTING TOOL AND METHOD OF SETTING A HYDRAULICALLY SETTABLE PACKER THEREWITH

BACKGROUND OF THE INVENTION

This invention is related to oil well packers which are hydraulically set and which include a tubing motion compensation feature to prevent motion of the tubing from interferring with the packer after it has been set yet at the same time permit fluid communication through the packer mandrel via the well tubing and the packer setting tool.

The prior art hydraulically set packers are constructed with the well tubing rigidly attached to the packer mandrel so that when the packer is set, the tubing is rigidly secured to the packer. Practice has shown this to be undesirable in some circumstances because motion of the tubing within the well bore can damage the packer components as well as destroy the fluid tight seal provided by the packer. This motion of the well tubing above the packer can be due to normal or routine well servicing operations carried out at the ground level or pumping and pressurization operations carried out where the tubing is involved. Because of this tubing motion, the motion compensation is highly desirable within the fluid connection between the packer and the well tubing. While this motion compensation can be accomplished by numerous constructions, it is most desirable to have this motion compensation combined with the ability to pump fluid through the packer setting tool for setting the packer as well as achieve the motion compensation.

SUMMARY OF THE INVENTION

An embodiment of this invention includes a hydraulic packer setting tool which is attached to the well tubing and positioned within the hydraulically settable well packer. The tool contains a valve which is open when the packer is set yet which closes when the setting tool is moved upward a predetermined amount so an accompanying seal nipple will maintain a fluid connection between the well tubing and the packer mandrel bore and compensate for vertical relative motion between the well packer and the tubing.

One object of this invention is to provide a hydraulic packer setting tool which overcomes the aforementioned disadvantages of the prior art devices.

Still, one other object of this invention is to provide a fluid flow control valve for a hydraulic packer setting tool which is opened and closed by motion into and out of the well packer.

Still, another object of this invention is to provide a hydraulic packer setting tool which functions to achieve setting of the packer and which provides for motion compensation between the packer and the tubing attached to the setting tool thus permitting fluid communication through the packer mandrel bore without fluid leakage into the annular cavity of fluid chamber above the packer within the casing around the tubing.

Various other objects, advantages and features of this invention will become apparent to those skilled in the art from the following discussion, taken in conjunction with the accompanying drawings, in which:

DESCRIPTION OF THE DRAWINGS

FIG. 3 is a view similar to FIG. 2 with the setting tool displaced further upward and the valve in the closed position;

FIG. 6 is an enlarged elevation view of the valve sleeve with the collet latching surfaces modified.

Figure 1A:
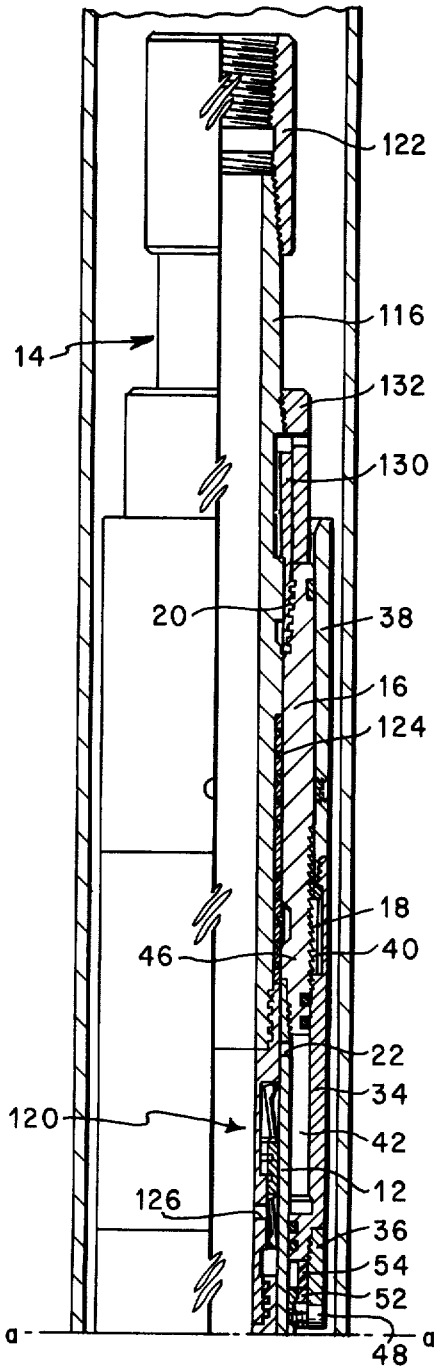
FIG. 1A, B and C comprise a partial cross-sectional elevation view of a hydraulic setting packer in the set position and a setting tool having the valve mechanism of this invention.

The following is a discussion and a description of preferred specific embodiments of the structure of this invention, such being made with reference to the drawings, whereupon the same reference numerals are used to indicate the same or similar parts and/or structure. It is to be understood that such discussion and description is not to unduly limit the scope of the invention.

DETAILED DESCRIPTION

Figure 1B:
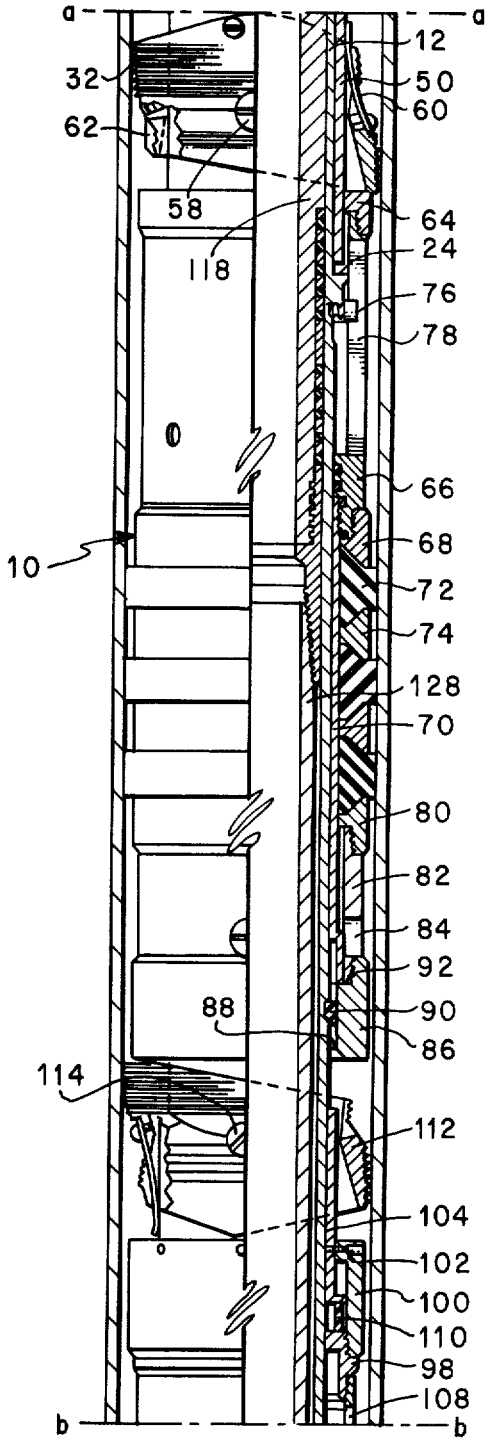
Figure 1C:
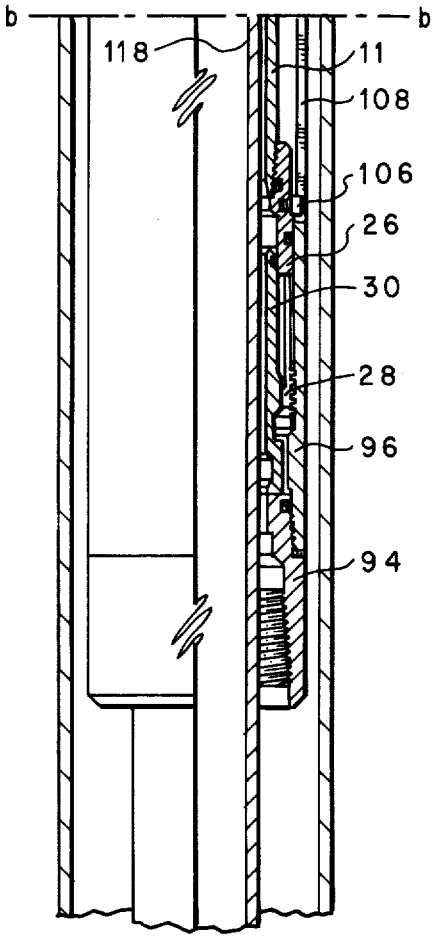

Referring now to FIG. 1, the hydraulically set well packer 10 is illustrated in this partial cross-sectional view in a set position with the setting tool in the appropriate position for setting the packer. The packer assembly generally comprises several telescopically constructed subassemblies generally consisting of an inner mandrel assembly, a packer mandrel 12, a hydraulic cylinder assembly, an upper slip assembly, an upper packer assembly, a lower packer assembly, and a lower slip assembly. The hydraulic setting tool or telescopic tubular assembly 14 is slidably mounted within the bore of packer mandrel 12 and secured to the packer while it is run into the well and positioned for setting of the packer. The hydraulic setting tool has the valve assembly of this invention mounted therewith and positioned within the packer.

DESCRIPTION OF THE PACKER

The inner mandrel assembly generally comprises an elongated tubular cylindrical packer mandrel 12 having threadedly attached at the top thereof a top connection sleeve 16. Top connection sleeve 16 has latch teeth 18 on its exterior thereof and threads 20 on its upper interior. A plurality of flow ports 22 (or setting ports) extend through packer mandrel 12 near the upper end thereof below the top connection sleeve 16. An annular abutment shoulder 24 is formed externally around the outer wall of mandrel 12 substantially below flow or setting ports 22. At the lower end of mandrel 12, a bottom collet sleeve 26 is threadedly attached thereto. Bottom collet sleeve 26 has a plurality of collet fingers 28 extending downwardly therefrom. Collet fingers 28 are formed by longitudinal slots through the wall of the bottom portion of collet sleeve 26. Collet fingers 28 have external threads on their lower end portion. Collet fingers 28 are maintained in an outwardly expanded direction by the location of a retrieval mandrel 30 located slidably within sleeve 26.

A tubular hydraulic cylinder assembly is located on the upper end portion of the packer and it has an upper slip abutment collar 36 on its lower end above the upper slip or tubular gripping member 32. The tubular hydraulic cylinder assembly has a main hydraulic cylinder 34 extending upward from collar 36 which has a guide 38 mounted at the top thereof. A spring collet sleeve 40 with teeth on the interior thereof is held between guide 38 and hydraulic cylinder 34. Spring collet sleeve 40 functions as a take-up latch assembly to secure the packer when the packer has been set. An annular hydraulic chamber 42 is formed between hydraulic cylinder 34, packer mandrel 12, and the bottom of a piston sleeve 46. Piston sleeve 46 is threadedly attached to the top of mandrel 12 and hydraulic cylinder 34 is slidably mounted on packer mandrel 12.

The upper slip assembly is located between slip abutment collar 36 and the upper packer assembly. Slip abutment collar 36 has a plurality of bolts 48 extending therethrough into slip carrier sleeve 50. A lock ring 52 is located between collar 36 and sleeve 50 and engages a peripheral groove formed in sleeve 50. An annular rubber spring 54 is held and trapped between lock ring 52 and the lower end of hydraulic cylinder 34. An upper unitary tubular gripping member, or slip, 32 is shearably mounted to carrier sleeve 50 by a pair of laterally opposed shear pins 58. This mounting of upper slip 32 permits rotation into the set position freely yet allows pins 58 to shear during retrieving of the packer. Upper slip 32 has external gripping teeth formed at diametrically opposed ends thereof for grippingly engaging the interior of the well casing. A leaf spring 60 is attached to upper slip 32 and abuts carrier sleeve 50 to continuously bias upper slip 32 to a radially inward non-gripping orientation. Upper slip 32 has a slot with an upper abutment shoulder formed on one side thereof. An unsetting lug 62 is formed on carrier sleeve 50 and extends radially outward inside of this slot within upper slip 32. An upper abutment shoulder in this slot is arranged to be contacted by the upper portion of unsetting lug 62 for pivoting upper slip 32 to a non-gripping position upon unsetting or release of the packer. During the unsetting motion of the packer, laterally opposed shear pins 58 are sheared, then the upper slip 32 is rotated and displaced upward relative to the stationary portions of the packer.

The upper packer assembly comprises an upper guide ring 64 attached to a guide cylinder 66 which is in turn connected to an upper packer head 68 around one end of a cylindrical packer sleeve 70. A plurality of elastomeric packer elements 72 are separated by metallic packer rings 74 located concentrically and slidably on packer sleeve 70. A guide pin 76 is threadedly engaged in mandrel 12 and projects radially outward into a slot 78 formed through the wall of sleeve 66 and in longitudinal axial alignment with mandrel 12. Slot 78 and guide pin 76 prevent relative rotation of the associated members of the packer when in service. The lower packer assembly generally consists of a lower packer head 80 slidably mounted on sleeve 70 and prevented from downward movement off of this sleeve by abutment with a radially outwardly extending annular shoulder formed near the bottom of the sleeve. Lower packer head 80 is in sliding abutment with the lower most packer element 72 and it has threadedly attached to the bottom thereof a lower spacer 82 with a plurality of ports 84 formed through the wall thereof. The bottom of this lower packer assembly is made up of a bottom ring 86 threadedly connected to spacer 82 and having an upward facing inner abutment shoulder 88 projecting inwardly for limiting abutment against slide limit ring 90. Slide limit ring 90 is mounted in an external groove around mandrel 12. A second upward facing abutment shoulder 92 is formed near the top of ring 86 for abutment with the bottom of packer sleeve 70.

The lower slip assembly has a bottom connector 94 at the lower end of the packer with a guide cylinder 96 through the mid-portion thereof and an adapter ring 98 at the upper end thereof. Threadedly attached to the top of adapter ring 98 is a slip control ring 100 which is connected by a plurality of shear pins 102 to a lower slip carrier sleeve, or lead in sleeve, 104. A guide pin 106 is threadedly engaged in the upper portion of collet sleeve 26 and projects radially outward into an elongated guide slot 108 longitudinally formed in the wall of guide cylinder 96. A rubber spring 110 is located in resilient abutting arrangement between adapter ring 98 and the bottom of carrier sleeve 104. A lower tubular gripping member, or slip, 112 is pivotally attached to carrier sleeve 104 by a pair of laterally opposed pins 114. Lower slip 112 is generally similar in construction to upper slip 32 but it is oriented in an invert position to oppose downward movement of the packer when set.

The hydraulic setting tool comprises an upper hydraulic mandrel 116, or latch seal nipple, threadedly connected to a lower hydraulic mandrel, or seal nipple, 118 by a valve collar or nipple assembly indicated generally at 120. The upper end of upper hydraulic mandrel 116 is threadedly connected by a collar 122 to the bottom of the tubing string. A plurality of external packing seals 124 are provided in a spaced relation on hydraulic mandrel 116 and on seal nipple 118. A port 126 is provided transversely through a midportion of valve collar assembly 120 to permit fluid to flow from the interior of the well tubing into the hydraulic setting cylinder assembly of the packer. The hydraulic setting tool extends in sealing engagement through piston sleeve 46 into packer mandrel 12. An elongated extension tube 128 is threadedly connected to the lower end of lower mandrel 118 and extends downward through the bottom end of the well packer. Preferably, a retrieving tool (not shown) is attached at the lower end of extension tube 128 for engagement with retrieval mandrel 30 when it is desired to unset or release the packer. Discussion of this retrieving tool and its operation is not pertinent here as it does not effect the operation or structure of this invention.

Attachment between hydraulic setting tool 14 and the packer which locks these members together for running into the well and positioning of the packer is accomplished by a locking device at the upper end of the packer. A locking sleeve 130 is secured to upper mandrel 116 by an abutment collar 132. Locking sleeve 130 is segmented and biased outward within abutment collar 132 by its own spring force. Abutment collar 132 is threadedly attached to upper mandrel 116, extends downward over the upper portion of locking sleeve 130 and abuts the upper end of top connection 16 when the packer is positioned for running into the well. The lower portion of locking sleeve 130 is threaded externally to mate with internal threads 20 at the upper end of top connection 16. The threads on locking sleeve 130 and the threads 20 are left handed so that rotation of the well tubing and attached upper mandrel 116 to the right will remove locking sleeve 130 from the packer and thus allow longitudinal sliding motion between the packer and the latch seal nipple. These threads are also formed as latch type threads which, along with the segmented construction of locking collar 132, will permit locking collar 132 to be stabbed into the upper portion of top connection 16 to secure the latch seal nipple and the packer.

Figure 5:
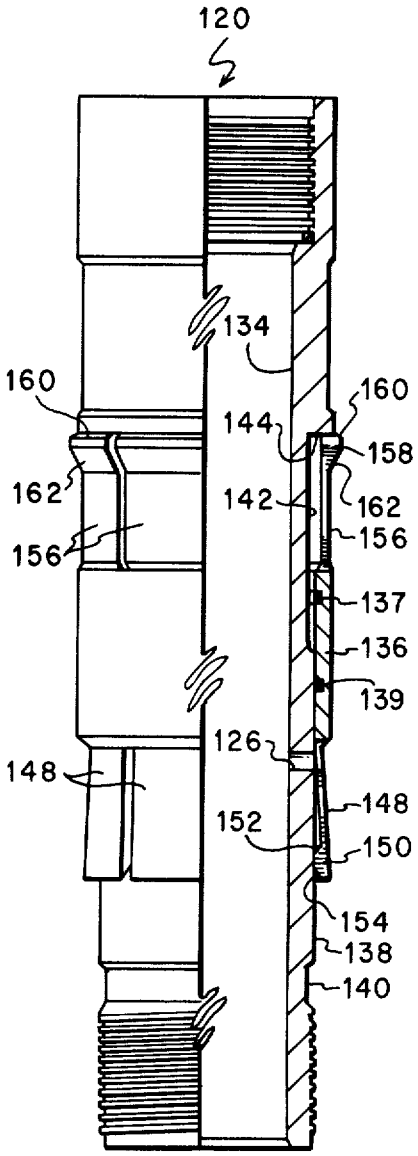
FIG. 5 is a partial cross-sectional elevation view of the valve nipple alone with the valve member in the open position.

FIG. 5 shows valve collar assembly 120 in an enlarged view with the valve thereof in the opened position. Valve collar assembly 120 is a nipple with an internally threaded upper end portion and an externally threaded lower end portion in a bore 134 therethrough. A valve nipple port 126 connects bore 134 with the exterior of the nipple. The valve member is a sleeve (or valve sleeve) 136 slidably mounted around a cylindrical exterior surface 138 on the nipple above and below port 126. Cylindrical surface 138 extends over a major portion of the nipple. Valve sleeve 136 slides longitudinally to cover and uncover port 126 to close and open the valve. The interior of valve sleeve 136 is provided with a pair of spaced apart O-rings 137 and 139 at the respective upper and lower mid-portions thereof. These O-rings are retained in annular grooves around the interior of the sleeve and seal on opposite sides of port 126 when the valve is closed. The exterior of the valve collar assembly is provided with a latching recess 140 around the lower end of cylindrical exterior surface 138 and above the lower exterior threads. Above cylindrical exterior surface 138 is a longitudinally elongated recess 142 around the nipple which terminates at a radially outwardly disposed and downwardly facing shoulder 144. Shoulder 144 extends radially outward beyond the radial dimension of surface 138.

Valve member 136 has an upper and lower actuator attached thereto which cooperatively engage recess 140 in the valve nipple and an internal recess 146 within the bore of top connection 16 to effect displacement of valve member 136 on the valve nipple during motion of the latch seal nipple unto and out of the packer. The valve lower actuator assembly includes a plurality of lower collet fingers 148 which extend downwardly from valve sleeve 136 in a natural unbiased condition around the inner portion of the sleeve. Collet fingers 156 are a segmented cylindrical extension of valve sleeve 136. The lower end portion of collet fingers 148 define a radially inwardly extending enlargement 150 of the collet. The major portion of lower collet fingers 148 lie adjacent to nipple cylindrical exterior surface 138 when the valve is closed. This arrangement biases lower collet fingers 148 inward in order to maintain contact between the radially inner portion of enlargement 150 and exterior surface 138 when the valve member is in the open position as shown in FIG. 5. Enlargements 150 have tapered latching surfaces 152 and 154 on upper and lower inner sides thereof which are inclined to correspond with the inclined sides of lower recess 140. Relative to a geometric plane lying perpendicular to the longitudinal axis of the valve nipple latching surface 152 can be inclined downward at an angle of between about 20° to about 40° from the elongated portion of lower collet finger 148 when it is in the unbiased position; and latching surface 154 is inclined upward from upper collet finger 156 at an angle of between about 50° to about 70°. When the valve is closed, enlargement 150 rests within lower recess 140 with inclined sides 152 and 154 thereof adjacent to associated sides of the recess.

The upper valve actuator includes a plurality of upper collet fingers 156 extending upward from valve member 136 in a cylindrical and naturally unbiased condition around the outer portion of the valve member. The collet fingers 156 are a segmented cylindrical extension of sleeve 136 and have a radially outwardly extending enlargement 158 at the upper end portion thereof with inclined latching surfaces 160 and 162 on upper and lower exposed portions of this enlargement. The interior of upper collet fingers 156 is spaced radially outward from the bottom of nipple recess 142 and from the interior of valve sleeve 136 as shown in FIG. 5. When valve collar assembly 120 is in packer mandrel 12 and some portions of top connection 16 upper collet fingers 156 are deformed inward because the exterior of enlarged portion 158 rides on the interior of the mandrel or the top connection depending upon its location. The upper end of upper collet fingers 156 rests against downwardly facing nipple shoulder 144 when the valve is in this position thereby limiting upward motion of the valve member. Latching surface 160 is inclined at a substantially steeper angle, relative to a geometric plane lying perpendicular to the longitudinal axis of the valve nipple, than lower latching surface 162. Relative to this geometric plane, latching surface 162 can be inclined upward at an angle of between about 50° to about 70°.

At this point, it is to be noted that the relative angular relation of surfaces 152 and 162 has a bearing upon the latching and releasing action of the collet fingers. The latching and releasing action of the collet fingers is determined by their ability to grip in their associated recesses and this ability substantially depends upon the angles of surfaces 152 and 162 and corresponding surfaces in their associated recesses as well as tension or biasing forces acting on the collet fingers. Due to the structural attachment and placement of the collet fingers on valve sleeve 136, this factor remains essentially constant. The inclination of the frustoconically shaped latching surfaces 152, 162 and the corresponding surfaces in recesses 140 and 146 can be changed by machining of the respective parts. Selecting the angular orientation of surfaces 152, 162 and the associated recess surfaces as noted above will cause the valve sleeve to remain open after it is manually arranged in the open position before the packer is assembled and while the assembly is inserted into the packer and then closed upon subsequent withdrawal from the packer. This selection will not permit the valve to reopen even if it is reinserted into the packer after it has been withdrawn because opening of the valve must be done manually after it is removed from a well. Another selection of these parameters for opening and closing the valve appears following the description of operation of the valve assembly.

OPERATION OF THE VALVE ASSEMBLY

Figure 2:
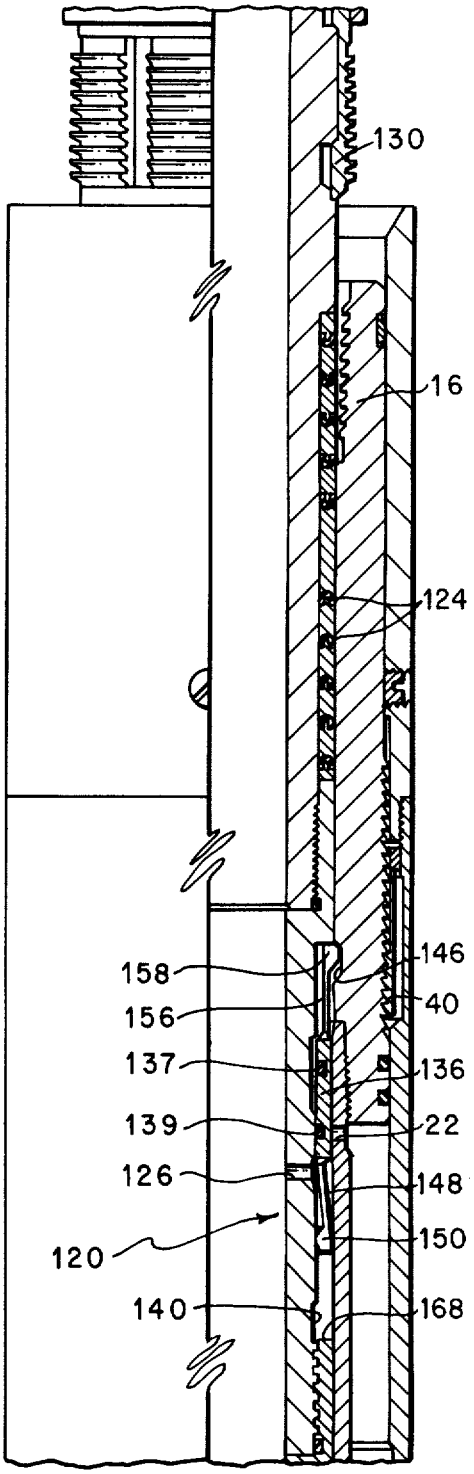
FIG. 2 is a partial cross-sectional elevation view of the upper portion of the packer shown in FIG. 1 and the setting tool in a condition wherein the packer is set, the setting tool raised, the valve open, and the upper end of the valve actuator collet engaged to initiate closing of the valve.

With the packer, seal nipple and hydraulic setting tool 14 in position as shown in FIG. 1, the valve collar assembly 120 is positioned as it appears in FIG. 5 with the valve being open to permit fluid flow from the well tubing through the latch seal nipple bore, valve nipple bore 134, valve nipple port 126, around the exterior of valve sleeve 136, through setting port 22 and into piston chamber 42. This fluid connection routes pressurized fluid from the well tubing above the packer to the packer setting mechanism and sets the packer within the well casing at the desired position. In order to provide an increase of fluid pressure inside the well tubing, a temporary blockage is created below port 126. This temporary blockage can be created by an expendable ball and seat or a wire line settable and retrievable plug either of which are commonly used in oil well hydraulically settable tools and will function adequately in this apparatus. Once the packer is set, then it is desirable to raise the well tubing so the sliding seal connection between the latch seal nipple and the interior of the packer mandrel will maintain the fluid connection and the unit will compensate for motion of the tubing relative to the stationary packer. This disconnection of the latch seal nipple from the packer is accomplished by rotating the well tubing in the right hand direction thereby unthreading the left hand threads of locking sleeve or collar 130 and top connection 16. When this is done, the tubing is raised vertically which pulls the latch seal nipple upward relative to the packer and thereby activates the valve actuator mechanism to close the valve. As the latch seal nipple moves upward from the position shown in FIG. 1, valve member 136 remains stationary on the valve nipple due to the friction of lower collet fingers 148 and nipple cylindrical exterior surface 138. When the latch seal nipple reaches a position shown in FIG. 2, upper collet fingers 156 are displaced radially outward into top connection recess 146 with enlarged portion 158 of upper collet fingers 156 extending into this recess. The upper collet finger upper latching surface 160 abuts the upper side of recess 146 and stops relative motion of valve sleeve 136 in top connection 16 as the latch seal nipple continues upward. The inclination of upper collet upper latching surface 160 is selected to create a binding force between top connection 16 and that collet which is sufficient to keep the valve sleeve in place against friction of the lower collet fingers and O-rings 137 and 139 sliding on nipple exterior surface 138. This stopping of relative motion causes valve sleeve 136 to be displaced downwardly on the valve nipple to the position shown in FIG. 3 where the valve is closed as the latch seal nipple continues upward.

Figure 4:
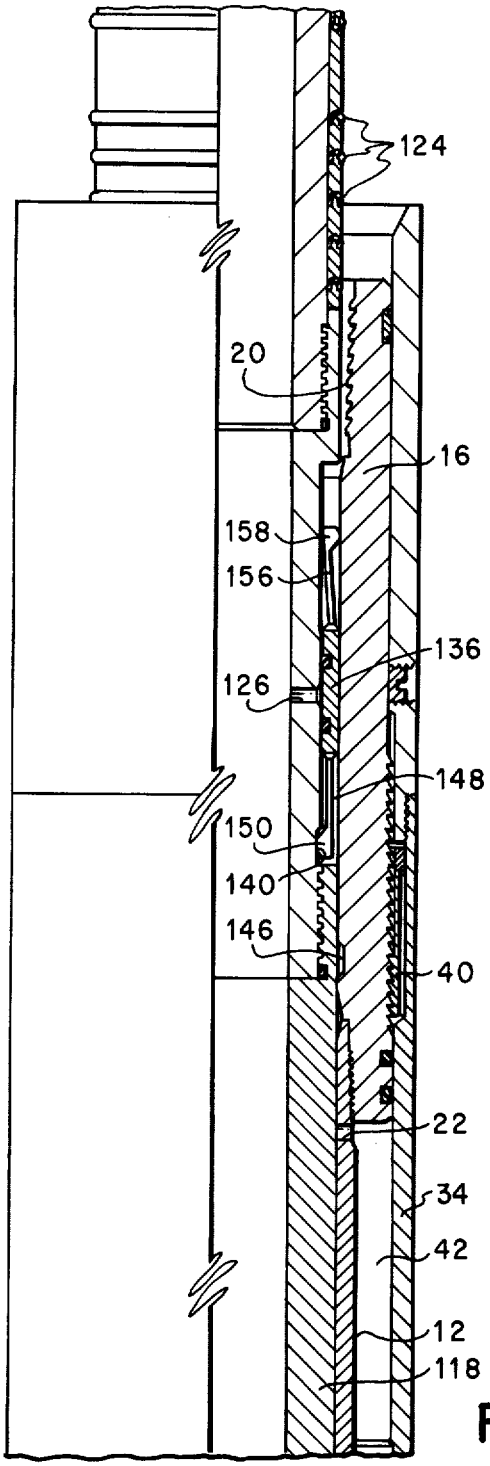
FIG. 4 is a view similar to FIG. 3 with the setting tool displaced further upward and the valve positioned within the bore of the top connection.

With the latch seal nipple, the valve and the packer positions as shown in FIG. 3, the valve is closed and further upward motion of the latch seal nipple will disengage upper collet fingers 156 from top connection recess 146 so as the latch seal nipple is further withdrawn from the packer, the valve will be closed. A radially outwardly extending and upwardly facing shoulder 168 on the upper end of lower seal nipple segment 118 at the joint below valve collar assembly 120 abuts the lower end of lower collet fingers 138. Also, The enlarged portion of lower collet fingers 148 slips radially inward into lower valve nipple recess 140 thereby securing valve sleeve 136 to the valve nipple in the closed position. As the latch seal nipple continues upward, the valve member will remain in the position shown in FIG. 3. Because of the substantial upward pull on the well tubing and the attached latch seal nipple and because the valve member and its associated upper and lower latch collets are carried with the latch seal nipple, this transmits sufficient force to the upper collet members 156 to slide enlarged portion 158 out of top connection recess 146 into the bore of the top connection. FIG. 4 shows the latch seal nipple and valve assembly in a position above top connection recess 146. During upward motion of the valve assembly through top connection 16, the outer peripheral surfaces of upper collet enlarged portion 158 slides along the interior of the top connection bore and upper collet members 156 remain displaced into recess 142. When the upper collet members pass out of the bore of top connection 16, they are displaced outward to the free position while the lower collet member 148 remain with their enlarged portions 150 engaged in lower recess 140 to retain valve sleeve 136 in the closed position.

In normal practice, the latch seal nipple is pulled upward so the valve sleeve 136 and lower collet fingers 148 are substantially above the upper end of the packer and so the latch seal nipple can accommodate substantial longitudinal motion compensation between the tubing and the packer. Because port 126 through the latch seal nipple is blocked, fluid communication is established through the well tubing, the latch seal nipple and further through the packer without communicating to the annular cavity around the well tubing above the packer. In the event that the well tubing and the latch seal nipple are lowered in the well sufficient to move valve sleeve 136 into the packer, it will not reopen the valve. The inclination of collet latching surfaces 152 and 162 prevent the valve sleeve from being secured to the packer mandrel and thus opened as the latch seal nipple moves downward. As the valve sleeve moves downward, upper collet enlarged portion 158 moves outward into top connection recess 146 while lower collet enlarged portion 150 is retained in lower recess 140. Because the relative inclination of surface 162 is shallower than the inclination of surface 152, this permits upper collet enlarged portion 158 to slip from recess 146 without creating sufficient force to displace lower collet enlarged portion 150 from lower recess thereby retaining valve sleeve 136 in the closed position.

When it is desired to unset or release the packer, the tubing is raised and appropriately positioned and manipulated to release the slips by using the retrieval tool whereupon the latch seal nipple remains above the packer and does not have to reenter the bore of the packer mandrel. In order to reset the packer, it is necessary to remove the packer from the well for repair and refurbishing. After the packer is removed from a well, the valve assembly is manually repositioned in the open position and the seal nipple assembly is reinserted in the packer.

Although the valve assembly described above does not reopen upon reinsertion of the latch seal nipple into the packer, it is to be noted that inclined surfaces 152 and 162 along with top connection recess 146 and lower recess 140 can be modified to cause the valve to be reopened upon reinsertion of the latch seal nipple. This modification to the latching surfaces 152 and 162 consists of substantially exchanging their angular orientations and correspondingly shaping the mating surfaces of recesses 140 and 146. This configuration of latching surfaces for the collet fingers is shown in FIG. 6 and with the modified upper and lower latching surfaces indicated at 152A and 162A respectively.

Provided this modification is done, then merely pushing the latch seal nipple straight into the packer mandrel until it assumes the position shown in FIG. 1, will automatically displace the valve sleeve to the open position and latch locking sleeve 130 with the top connection 16. As the latch seal nipple is displaced into the packer, the valve member or sleeve is carried in the position shown in FIG. 4 and prevented from sliding upward due to the engagement of lower collet enlarged portion 150 with lower recess 140. This attachment of the valve member and the valve nipple is temporary and continues until upper collet members 156 pass top connection recess 146 and the enlarged portions thereof 158 are displaced outward into this recess. At this point, continued downward motion of the latch seal nipple will cause lower collet members 148 to have their enlarged portions withdrawn from lower recess 140 because of the gripping engagement between upper collet member lower latching surface 162A and the appropriate surface in recess 146. At this point, it is to be noted that the relative angular relation of upper collet lower latching surface 162A and lower collet upper latching surface 152A are selected so that a sufficient force is required to release the upper collet members from their associated recess and this force is greater than the retaining force of the lower collet members when the latch seal nipple is moving downward. After upper collet members 158 are engaged, the continued downward motion of the latch seal nipple will disengage lower collet members 148, because of the shallower inclination of latching surfaces 152A, and cause them to move radially outward and slide on nipple cylindrical exterior surface 138 and at the same time displace valve member 136 from the position covering port 126 thereby opening the valve. When the valve is opened and the latch seal nipple has been displaced sufficiently downward to bring upper collet members 158 into an abutting relation with valve nipple shoulder 144, then continued downward displacement of the latch seal nipple will urge these collet members from recess 146 by inclined surface 162A sliding on the lower surface of top connection recess 146. When this occurs, the continued downward motion of the latch seal nipple will eventually bring it into the position shown in FIG. 1. Shortly before the latch seal nipple reaches the position shown in FIG. 1, locking sleeve 130 engages the upper end of top connection 16. Due to the segmented construction of locking sleeve 130 and the latching threads on adjoining portions of these members, it is not necessary to rotate the members to accomplish the threaded connection. Merely pushing the latch seal nipple into the top connection will let the inclined surfaces of the threads slide past each other until a secure connection is achieved. It is to be noted that if desired, this connection can be made up by rotating the members.

As can be seen from the above, a valve assembly has been provided for use with a hydraulically set packer which will enable fluid communication to be established and maintained through the packer without leakage into the annular fluid cavity around the well tubing above the packer. This valve mechanism is open for setting the packer through fluid pressure applied in the tubing and it is closed upon raising a seal nipple assembly from the packers. Raising the seal nipple closes the valve and at the same time provides for motion compensation between the well tubing and the packer.

The embodiments of the invention in which an exclusive property or privilege is claimed are defined as follows:

1. A well packer for sealing and gripping engagement in a well bore, said packer comprising:

an elongated inner tubular mandrel assembly extending substantially the length of said well packer;

a tubular upper slip assembly having a unitary tubular pivotable gripping member located in encircling relationship on said mandrel assembly, said upper slip assembly being arranged for telescopic movement on said mandrel assembly and being frangibly attached thereto;

a tubular packer assembly slidably located in encircling relation on said mandrel assembly below said upper slip assembly, having resilient annular packer means located slidably thereon, and arranged for abutment with said upper slip assembly;

a tubular lower slip assembly having a unitary tubular pivotable gripping member located therearound and arranged for telescopic sliding movement on said mandrel assembly into abutment with a lower portion of said packer assembly;

a telescopic hydraulic actuator means between said mandrel assembly and said upper slip assembly having a piston and cylinder means with a fluid passageway to a piston chamber thereof through said mandrel assembly, said actuator means being operably to telescopically expand for rotating and setting said upper and lower slip assemblies upon the application of fluid pressure through said mandrel assembly;

means releasably securing said lower slip assembly to said mandrel assembly;

take-up latching means between said upper slip assembly and said mandrel assembly and arranged to allow telescopic movement therebetween in one relative longitudinal direction while preventing telescopic movement therebetween in the opposite direction;

a tubular seal nipple assembly slidably telescopically mounted within said mandrel assembly having latching means for temporary attachment to said mandrel assembly and being mountable in fluid communication with well tubing for positioning and placement of said well packer in a well; and valve means with said seal nipple assembly having a valve member movable between open and closed positions for communicating well fluid from within well tubing and said tubular seal nipple assembly to said hydraulic actuator means for setting said well packer when in the open position and preventing fluid communication from said tubular seal nipple assembly to a zone above said well packer when in the closed position.

2. The well packer of claim 1, wherein:

said valve means has a valve actuator means therewith which is operably engageable with said mandrel assembly and said telescopic hydraulic actuator means for movement between open and closed positions upon telescopic movement of said mandrel outward from said packer in order to permit fluid passage through the interior of said mandrel and said packer while maintaining a fluid tight seal between said mandrel assembly and said packer.

3. The well packer of claim 1, wherein:

(a) said valve means has a valve actuator means operably mounted with a valve member and engageable with said mandrel assembly and said telescopic actuator means for closing said valve means during telescopic motion of said mandrel assembly relative to said packer;

(b) said valve actuator means has an upper latch means arranged to temporarily secure said valve means to said mandrel assembly as said telescopic actuator assembly is moved upward in order to close said valve means, and said valve actuator means also arranged to release said valve means from said temporary securement upon further upward motion of said seal nipple assembly; and (c) said valve actuator means has a lower latch means arranged to temporarily secure said valve means in a fixed position on said seal nipple assembly with said valve means in said closed position.

4. The well packer of claim 1, wherein:

said valve means has a valve actuator means therewith which is operably engageable with said mandrel assembly and said telescopic hydraulic actuator means for movement between open and closed positions corresponding to telescopic movement of said mandrel into said packer in position for setting said packer and movement of said mandrel outward from said packer in order to permit fluid passage through the interior of said mandrel and said packer and additional telescopic movement of said mandrel assembly relative to said packer while maintaining a fluid tight seal between said mandrel assembly and said packer.

5. The well packer of claim 1, wherein:

(a) said valve means has a valve actuator means operably mounted with a valve member and alternately engageable with said mandrel assembly and said telescopic actuator means for opening and closing said valve means during telescopic motion of said mandrel assembly relative to said packer;

(b) said valve actuator means has an upper latch means arranged to temporarily secure said valve means to said mandrel assembly as said telescopic actuator assembly is moved upward in order to close said valve means, and to release said valve means from said temporary securement upon further upward motion of said seal nipple assembly;

(c) said upper latch means arranged to temporarily secure said valve means to said mandrel assembly as said telescopic actuator assembly is moved downward in order to open said valve means and to release said valve means from said temporary securement upon further downward motion of said seal nipple assembly; and (d) said valve actuator means has a lower latch means arranged to temporarily secure said valve means in a fixed position on said seal nipple assembly with said valve means in said closed position.

6. In a hydraulically settable well packer having an elongated tubular packer mandrel assembly extending longitudinally within said well packer and having a slip assembly with a gripping member located thereon, said slip assembly being arranged for movement on said packer mandrel assembly from an unset position to a set position; a tubular packer assembly slidably mounted on said packer mandrel assembly adjacent to said slip assembly and including a resilient annular packer element for sealing engagement with a well bore; hydraulic actuator means between said packer mandrel means and said slip means and arranged to displace said slip means and said packer element to a set position in a well bore; a fluid passageway through said mandrel assembly arranged in fluid communication with a fluid inlet of said hydraulic actuator means to pass fluid therein for actuating said hydraulic actuator means for setting said slip means and said packer assembly; and a telescopic tubular seal assembly mounted within said tubular packer mandrel assembly and having an outer peripheral seal assembly therearound to maintain sealing engagement with said tubular packer mandrel and having a fluid passage therethrough arranged to provide fluid communication to said hydraulic actuator means inlet; an improvement in said well packer comprising:

a valve means movably mounted with said telescopic tubular seal assembly at said fluid passage and movable between open and closed positions to control fluid flow from said inner mandrel assembly through said fluid passage to said hydraulic actuator means; and valve actuator means with said telescopic tubular seal assembly, said valve means, said packer mandrel means and said hydraulic actuator means to move said valve means from the open position to the closed position upon telescopic movement of said tubular seal assembly upward from said well packer.

7. The improvement of claim 6, wherein said valve actuator means has means to move said valve means from the closed position to the open position upon telescopic movement of said tubular seal assembly into said well packer from an extended position where said valve means is in a closed position.

8. The improvement of claim 6, wherein said valve sleeve is mounted on a nipple joined into a mid-portion of said tubular seal assembly.

9. The improvement of claim 6, wherein:

(a) said valve means has a tubular valve sleeve slidably mounted around said tubular seal assembly and arranged to be positioned for blocking fluid flow through said fluid passage when said valve means is in said closed position;

(b) said valve actuator means has an upper latch means arranged to temporarily secure said sleeve to said packer mandrel assembly as said tubular seal assembly is moved upward to close said valve means, and also arranged to release said sleeve from temporary securement upon further upward motion of said tubular seal assembly; and (c) said valve actuator means has a lower latch means arranged to temporarily secure said valve sleeve in a fixed position on said tubular seal assembly when said valve means is in said open position and to secure said valve sleeve on said tubular seal assembly when said valve means is in said closed position.

10. The improvement of claim 9, wherein:

(a) said valve actuator means lower latch means has a segmented annular collet member having an annular and radially inwardly extending enlargement around a lower end portion thereof for engagement with said tubular seal assembly; and (b) said upper latch means has a segmented annular collet member extending upward from said valve sleeve with an annular and radially outward extending enlargement around an upper end portion thereof for engagement with an interior portion of said packer mandrel assembly.

11. The improvement of claim 10, wherein:

(a) said valve sleeve has a pair of seal rings mounted in a spaced relation around the interior thereof and arranged to be positioned on opposite sides of said fluid passage with said valve sleeve in the closed position;

(b) said lower latch means segmented annular collet member has radially inwardly facing latch surfaces around the interior thereof;

(c) said nipple has an annular recess around the exterior thereof with said recess having latching surfaces shaped to cooperatively engaged said lower latch means latching surfaces for retaining said valve sleeve in a closed position and said tubular seal assembly has an upwardly facing radial abutment adjacent to the lower portion of said annular recess;

(d) said upper latch means segmented annular collet member has radially outwardly facing latching surfaces around upper and lower side portions of said enlargement thereof; and (e) said packer mandrel assembly has an annular recess around the interior thereof spaced substantially above said hydraulic actuator fluid inlet, said annular recess has latching surfaces formed therein which are cooperatively engageable with said upper latch means latching surfaces to temporarily secure said valve sleeve to said packer mandrel assembly upon upward movement of said telescopic tubular assembly in said packer mandrel.

12. The improvement of claim 10, wherein:

(a) said upper latch means has a lower latch surface which cooperatively engages a lower latch surface of said packer mandrel means annular recess;

(b) said lower latch means has an upper latch surface which cooperatively engages an upper latch surface of an annular recess on said tubular seal assembly; and (c) said latch means latch surfaces and their associated recess latch surfaces are oriented such that a significantly larger force is required to release said lower latch means than said upper latch means when said valve sleeve is moving upward on said tubular seal assembly than when said valve sleeve is moving downward within said packer mandrel assembly in order to prevent opening of said valve means upon motion of said valve sleeve into said packer mandrel assembly.

13. The improvement of claim 10, wherein:

(a) said upper latch means has a lower latch surface which cooperatively engages a lower latch surface of said packer mandrel means annular recess;

(b) said lower latch means has an upper latch surface which cooperatively engages an upper latch surface of an annular recess on said tubular seal assembly; and (c) said latch means latch surfaces and their associated recesses are oriented such that a significantly larger force is required to release said upper latch means than said lower latch means when said valve sleeve is moving downward within said packer mandrel assembly in order to provide for opening of said valve means upon motion of said valve sleeve into said packer mandrel assembly.

14. A method of installing a hydraulically settable well packer comprising the steps of:

(a) inserting a hydraulic setting tool into a hydraulically settable well packer wherein the setting tool has an operable and closeable valve for controlling fluid flow from an opening therein through a port in an outer wall thereof with said valve arranged in the open position;

(b) connecting the hydraulic setting tool to well tubing and positioning the well packer at a desired location in a well bore;

(c) temporarily blocking fluid flow through the hydraulic setting tool at a location below said port;

(d) applying fluid pressure to the well packer through the well tubing, the hydraulic setting tool, the port and the valve for operable actuating a hydraulic setting mechanism of the well packer to set the packer;

(e) partially withdrawing the hydraulic setting tool from the well packer; and (f) closing the valve in order to prevent fluid communication between the interior of the well tubing and an annular cavity above the well packer around the well tubing.

15. The method of claim 14, further including said partially withdrawing the hydraulic setting tool and said closing the valve being done simultaneously.

16. The method of claim 14, further including said closing the valve includes displacing the hydraulic setting tool a portion of the distance it is to be withdrawn from the well packer, then temporarily securing a valve member of the valve to the well packer so that continuing withdrawal of the hydraulic setting tool displaces the valve member to the closed position, then releasing the temporary secured valve member from the well packer upon continuing withdrawal of said hydraulic setting tool.

17. The method of claim 14, further including opening the valve upon insertion of the hydraulic setting tool into the packer to the secured location.

18. The method of claim 17, further including said inserting a hydraulic setting tool and said opening the valve being done simultaneously.

19. The method of claim 17, further including said opening the valve includes inserting the hydraulic setting tool a portion of the distance which it is to be inserted into the well packer, then temporarily securing a valve member of the valve to the well packer so continuing insertion of the hydraulic setting tool into the well packer displaces the valve member from the closed position to the open position, then releasing the temporarily secured valve member upon continuing insertion of the hydraulic setting tool as it moves to a final resting position within the well packer.

20. A method of installing a hydraulically settable well packer comprising the steps of:

(a) inserting a hydraulic setting tool into a hydraulically settable well packer wherein the setting tool has an operable and closeable valve for controlling fluid flow from an opening therein through a port in an outer wall thereof with said valve being in the closed position;

(b) opening the valve;

(c) connecting the hydraulic setting tool to well tubing and positioning the well packer at a desired location in a well bore;

(d) temporarily blocking fluid flow within the hydraulic setting tool below said port;

(e) applying fluid pressure to the well packer through the well tubing, the hydraulic setting tool, the port and the valve for actuating a hydraulic setting mechanism of the well packer;

(f) partially withdrawing the hydraulic setting tool from the well packer; and (g) closing the valve in order to prevent fluid communication between the interior of the well tubing and an annular cavity above the well packer and around the well tubing.

21. The method of claim 20, further including:

(a) said partially withdrawing the hydraulic setting tool and said closing the valve being done simultaneously; and (b) said inserting a hydraulic setting tool and said opening the valve being done simultaneously.

22. The method of claim 20, further including:

(a) said closing the valve includes displacing the hydraulic setting tool a portion of the distance it is to be withdrawn from the well packer, then temporarily securing a valve member of the valve to the well packer so that continuing withdrawal of the hydraulic setting tool displaces the valve member to the closed position, then releasing the temporary secured valve member from the well packer upon continuing withdrawal of said hydraulic setting tool; and (b) said opening the valve includes inserting the hydraulic setting tool a portion of the distance which it is to be inserted into the well packer, then temporarily securing a valve member of the valve to the well packer so continuing insertion of the hydraulic setting tool into the well packer displaces the valve member from the closed position to the open position, then releasing the temporarily secured valve member upon continuing insertion of the hydraulic setting tool as it moves to a final resting position within the well packer.

* * * * *